US005368291A

United States Patent [19]

MacNiel

[11] Patent Number: 5,368,291

[45] Date of Patent: Nov. 29, 1994

[54] MEDIA STRIPPER MECHANISM

[75] Inventor: Douglas K. MacNiel, Costa Mesa, Calif.

[73] Assignee: CalComp, Inc., Anaheim, Calif.

[21] Appl. No.: 54,339

[22] Filed: Apr. 30, 1993

[51] Int. Cl.[5] ..... B65H 29/54

[52] U.S. Cl. ..... 271/308; 83/145; 83/162

[58] Field of Search ..... 83/81, 105, 106, 119, 83/145, 162; 242/56.2, 56.3, 56.5; 101/224, 226, 227, 228, 232; 271/308, 311; 250/231.1, 231.14

[56] References Cited

U.S. PATENT DOCUMENTS 3,926,429 12/1975 Satomi et al. ..... 271/308
3,991,999 11/1976 Brooke ..... 271/308
4,261,560 4/1981 Yanagawa et al. ..... 271/308
4,942,795 7/1990 Linke et al. ..... 83/403.1 X
4,951,936 8/1990 Taniyama ..... 271/308 X
5,153,437 10/1992 Nishii et al. ..... 250/231.14
5,217,220 6/1993 Carlson et al. ..... 271/308 X

*Primary Examiner*—Eugenia Jones
*Attorney, Agent, or Firm*—Frederic P. Smith; William F. Porter, Jr.

[57] ABSTRACT

A media stripper mechanism for a plotter in which the media is supported by a support having a recess therein adapted to be covered by the media. A stripper is positioned external of the support and is adapted to be extended a preselected distance into the recess. A mover is provided for moving the stripper into the recess prior to the covering thereof by the media, whereby the media is stripped from the support by the stripper.

2 Claims, 3 Drawing Sheets

MEDIA STRIPPER MECHANISM

BACKGROUND OF THE INVENTION

1. Field of the Invention

This invention relates to the field of plotters and, in particular, to a media stripper mechanism for a plotter which separates the media from a supporting surface within the plotter and guides the media away from such supporting surface.

2. Description of Related Art

It is common practice in the use of plotters to provide tracings in a variety of colors. These multicolor plots are often accomplished by having the media pass several times through the plotter, once for each color. This is generally accomplished by rolling the media onto a takeup roller during a single color plot, then winding the media back onto the original roll for use during a second color plot. After subsequent color plots, the media is rewound to be finally color plotted and taken out of the plotter. The final plot and take out follows the same previous media passes, except that during the takeoff the media is cut transversely and lengthwise, if necessary. While the same media pass is used, the media cannot be allowed to roll up onto the takeup roller. In prior art devices, this final takeout function was accomplished by by-passing the takeup roller and either pushing or pulling the media by hand or by a separate drive or pull mechanism out of the plotter since a suitable mechanism was not available for stripping or peeling the media from the takeup roller and guiding and redirecting it out of the plotter.

Thus, it is a primary object of the present invent to provide a media stripper mechanism for a plotter.

It is another object of the present invention to provide a media stripper mechanism for a plotter which selectively strips or peels the media from the takeup roller.

It is a further object of the present invention to provide a media stripper mechanism for a plotter which is able to both strip media from a surface and direct the media into a preselected direction.

It is still another object of the present invention to provide a media stripper mechanism for a plotter which is compact, rugged and low cost.

SUMMARY OF THE INVENTION

A media stripper mechanism for a plotter is provided in which the media is supported by a support means having a recess therein adapted to be covered by the media. A stripper means is positioned external of the support means and is adapted to be extended a preselected distance into the recess. Means are provided for moving the stripper means into the recess prior to the covering thereof by the media, whereby the media is stripped from the support means by the stripper means.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 5 is an exploded isometric view of the stripper housing and cam assembly of the present invention.

DESCRIPTION OF THE PREFERRED EMBODIMENT

Figures 1, 2, 3:
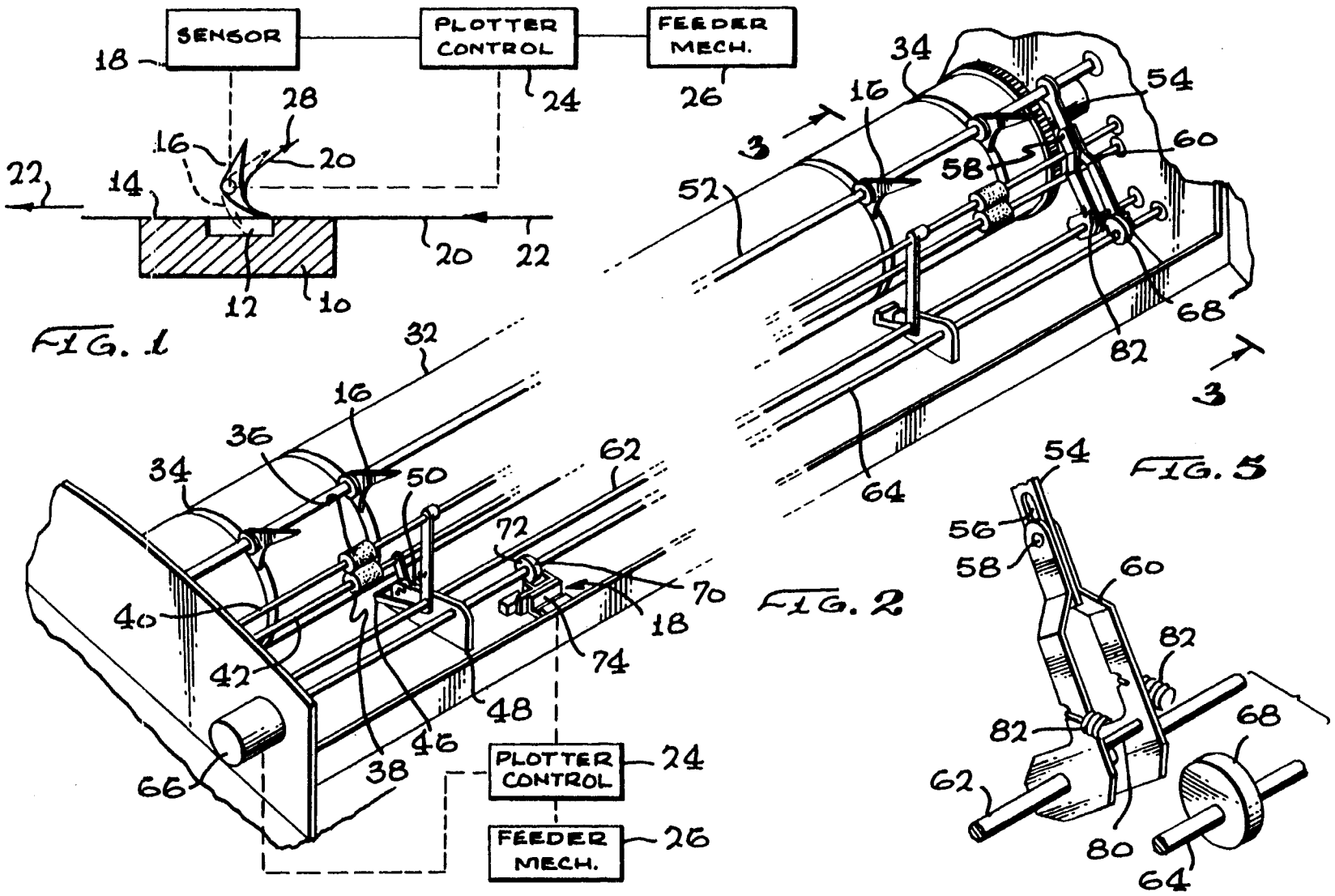
FIG. 1 is a simplified drawing illustrating the principle of operation of the present invention.
FIG. 2 is an isometric view of the present invention in its intended environment.
FIG. 3 is a cross-sectional view of FIG. 2 taken along line 3—3 of FIG. 2.
Figure 3:
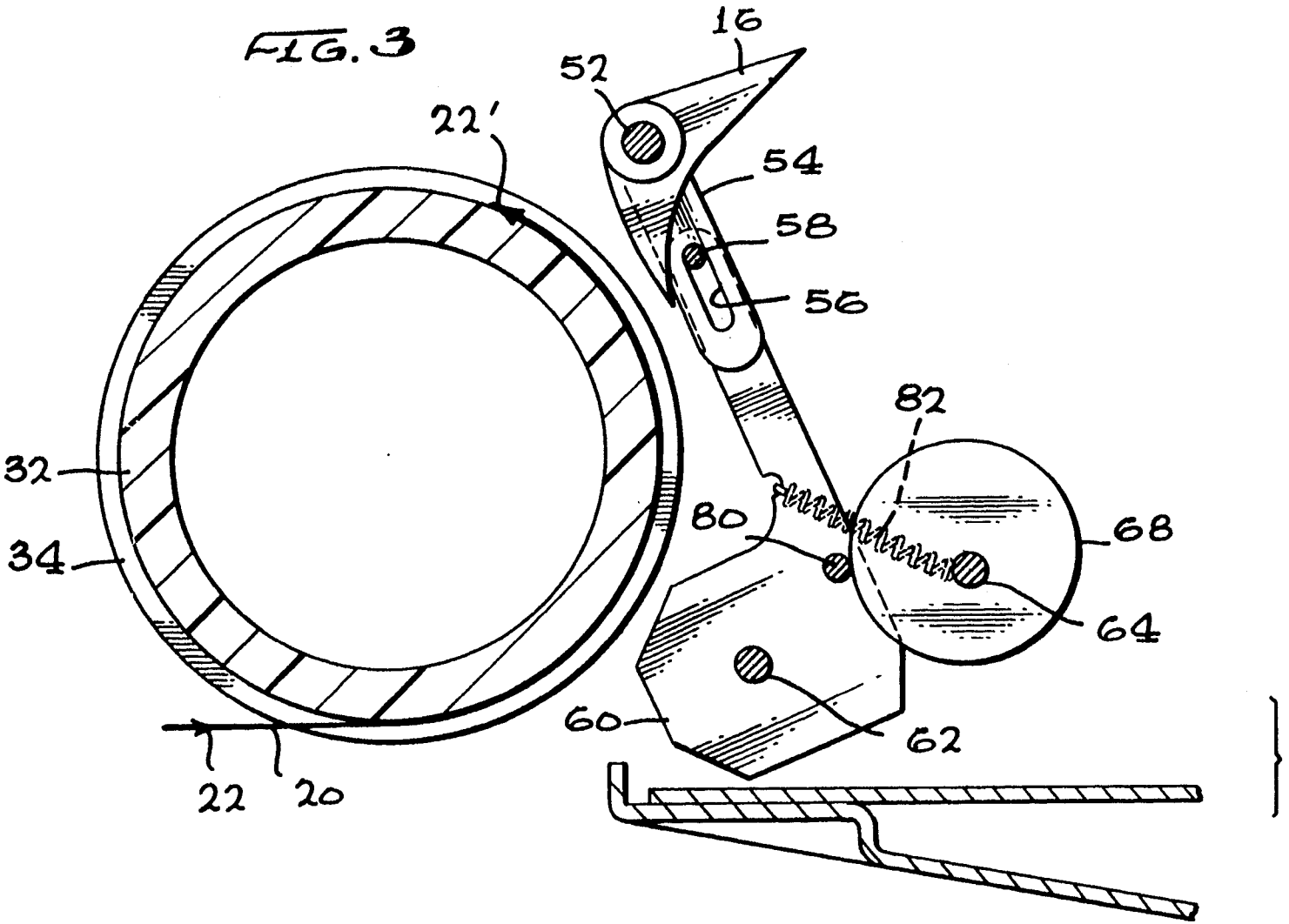

Referring now to FIG. 1, a platen 10 is shown having a recess 12 in the surface 14 thereof. A stripper blade 16 is positioned above the surface 14 of the platen 10 and has a sensor 18 coupled thereto which detects the position of the stripper blade 16. The stripper blade 16 normally allows media 20 travelling, in the direction of arrow 22, to pass thereunder over the surface 14 of the platen 10. When it is desired to strip or peel the media 20 from the surface 14 of the platen 10, plotter control 24, which receives a position signal from sensor 18, causes the stripper blade 16 to rotate into the recess 12, as shown in phantom, until the sensor 18 indicates that the stripper blade 16 is fully rotated into the recess 12 and sends a signal to plotter control 24 to stop further rotation of stripper blade 16. Prior to the rotation of stripper blade 16, plotter control 24 also sends a signal to a feeder mechanism 26 which stops media 20 from being fed to platen 10 so that stripper blade 16 can rotate into recess 12 before the media 20 arrives at the surface 14 of platen 10 and covers recess 12. When the stripper blade 16 is in operational position in the recess 12, plotter control 24 signals feeder mechanism 26 to feed the media 20 to the platen 10 where the media 20 now encounters the stripper blade 16 which strips the media 20 from the surface 14 and guides and redirects it in the direction of arrow 28. While the stripper blade 16 can be made in a variety of shapes, the particular crescent shape has been found to be quite suitable for the stripping and redirecting operation.

In FIGS. 2–6, the media stripper mechanism of the present invention is illustrated operating in its intended environment. A plotter is shown having a takeup roller 32 which is driven either to roll up the media 20 or to support the media 20 to be cut by a cutter, not shown. In the event the takeup roller 32 supports the media 20 for cutting by a cutter, the takeup roller 32 need not be driven but may be merely rotatable or even stationary as long as the media 20 is capable of being drawn over it. The takeup roller 32 has one or more circumferential grooves 34 therein which cooperate with one or more stripper blades 16 to strip the media 20 from takeup roller 32. Adjacent the takeup roller 32 are a plurality of pinch rollers 36,38 supported on shafts 40,42. The shafts 40,42 are mounted on brackets 44,46 which are pivotally coupled to support 48. Spring 50 is coupled to bracket 44 and support 48 and urges the shafts 40,42 and pinch roller 36,38 into contact with the takeup roller 32, thus, along with a vacuum assist (not shown), keeping media 20 in intimate contact with takeup roller 32.

As shown in the Figures, stripper blades 16 are supported by shaft 52 which in turn is supported by a pair of arms 54, only the right one of which and its accompanying drive assembly is illustrated. The arm 54 has a slot 56 therein and is linked by pin 58 to housing assembly 60 which is mounted on and can pivot around shaft 62 which is supported by support 48. Parallel to shaft 62 is shaft 64, driven by motor 66, which is also supported by support 48 and carries a cam 68, which interacts with housing assembly 60, and a disc 70 which forms part of sensor 18.

Figure 6:
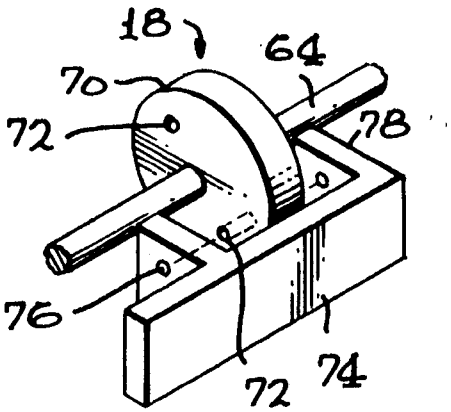
FIG. 6 is an enlarged isometric view of the photooptic sensor of the present invention.
Figure 4:
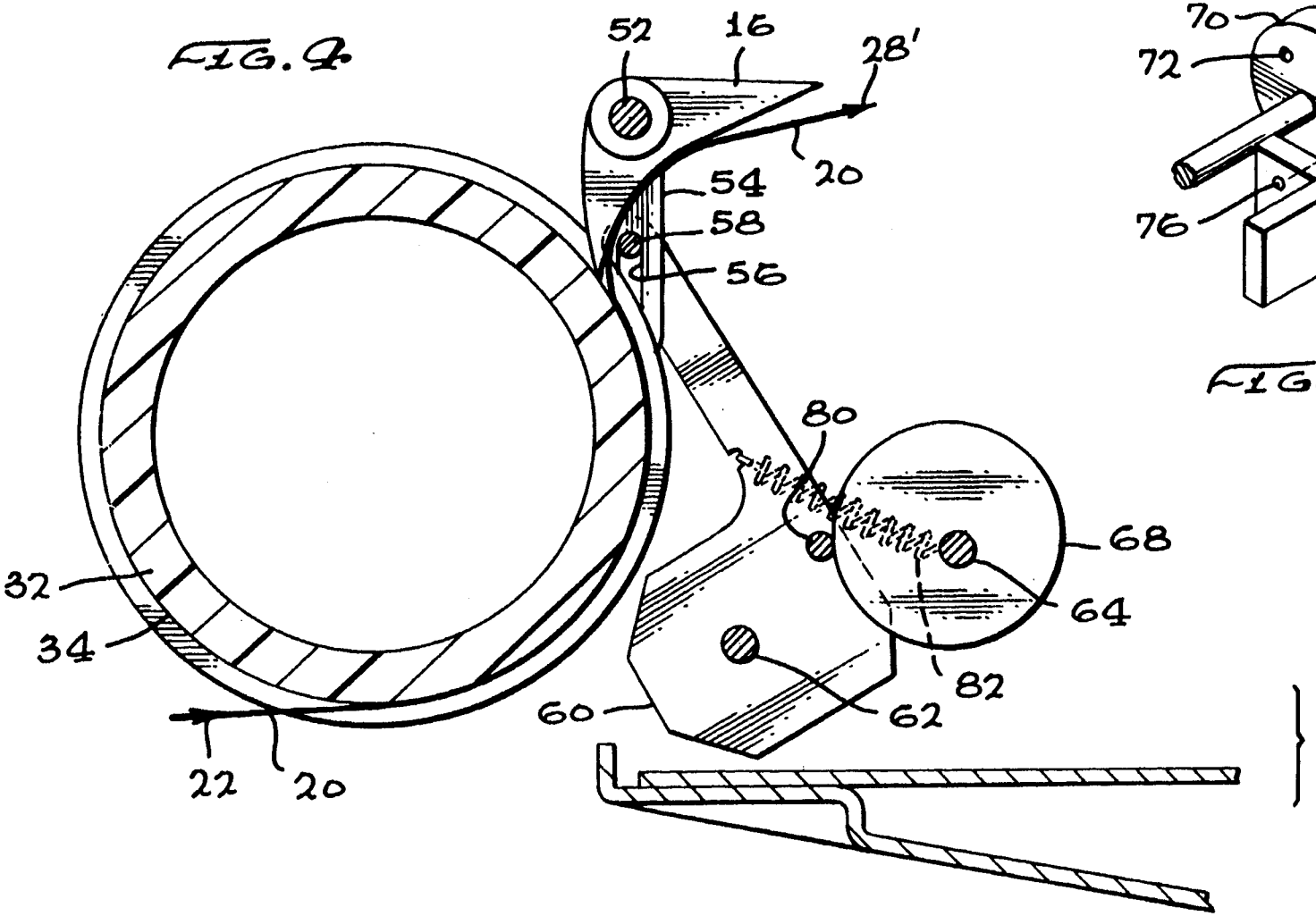
FIG. 4 is a cross-sectional view of FIG. 2 similar to FIG. 3 but showing the present invention in its operational mode.

In normal takeup operation, the media 20 approaches takeup roller 32 from bottom left (see FIG. 3), passes under the stripper blade 16 and proceeds to be rolled up on takeup roller 32, assisted by the pinch rollers 36,38 and the vacuum applied to media 20 through holes in the takeup roller 32. When it is desired to strip the media 20 from the takeup roller 32, plotter control 24 instructs feeder mechanism 26 to stop the flow of media 20 to the takeup roller 32, generally at a cross-cutter mechanism, not shown. Plotter control 24 then instructs motor 66 to rotate shaft 64 until the sensor 18 determines that the stripper blades 16 are in proper position. As seen in FIGS. 2 and 6, sensor 18 consists of a disc 70 and a member 74. The disc 70 has a plurality of holes 72 therein and is mounted on shaft 64 and rotates between the two arms 76,78 of member 74, member 74 having a photodiode in one arm and a photodetector in the other arm and being coupled to plotter control 24. Thus plotter control 24 is able to determine the rotational position of shaft 64 by the passage of light through the holes 72. Also mounted on shaft 64 is cam 68 which may be eccentrically mounted or have a contoured surface. Cam 68 engages cross member 80 which is mounted on housing assembly 60 and which acts as a cam follower. As shown in FIG. 4, when shaft 64 is rotated, cam 68 causes housing assembly 60 to rotate counter-clockwise around shaft 62. This causes pin 58 to ride up in slot 56 and also to exert a force on arm 54 to cause stripper blade 16 to rotate clockwise around shaft 52 and move into the groove 34 in takeup roller 32. When the disc 70 has rotated a preselected amount to expose the next hole 72 therein, thus indicating that the stripper blade 16 has sufficiently entered the groove 34, sensor 18 sends a signal to plotter control 24 which stops motor 66 and instructs feeder mechanism 26 to send media 20 to the takeup roller 32. After going part way around takeup roller 32, media 20 encounters stripper blade 16 which proceeds to peel media 20 from the takeup roller 32 and guide and redirect the media 20 away from the takeup roller 32 in the direction of arrow 28'. When it is no longer desired to have the stripper blade 16 positioned in the groove 34, plotter control 24 causes motor 66 to rotate shaft 64 a preselected amount, as determined by sensor 18. Cam 68 thus rotates back to its original position and spring 82 returns housing assembly 60 and thus stripper blade 16 back to their initial positions.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

I claim:

1. A media stripper mechanism for a plotter comprising:

support means for supporting a media, said support means having a recess therein positioned to be at least partially covered by said media;

stripper means positioned external of said support means and movable a preselected distance into said recess;

mover means for moving said stripper means into said recess prior to the covering thereof by said media, whereby said media is stripped from said support means by said stripper means, said mover means including cam means for moving said stripper means into said recess; and sensor means for sensing the position of said cam means and for generating a sensor signal indicative of said position, whereby the position of said stripper means relative to said recess is determined and said cam means moves said stripper means into said recess prior to said recess being covered by said media to strip said media from said support means.

2. The media stripper mechanism of claim 1 wherein said mover means further includes drive means coupled to said cam means, said drive means being coupled to a plotter control for receiving said sensor signal and for providing a signal to said drive means to control the position of said cam means and the position of said stripper means relative to said recess.

* * * * *